United States Patent [19]

Kucharczyk

[11] 4,164,265

[45] Aug. 14, 1979

[54] BAFFLE

[75] Inventor: Eckhard Kucharczyk, Netphen, Fed. Rep. of Germany

[73] Assignee: Siegenia-Frank KG., Siegen, Fed. Rep. of Germany

[21] Appl. No.: 897,152

[22] Filed: Apr. 17, 1978

[30] Foreign Application Priority Data

Apr. 16, 1977 [DE] Fed. Rep. of Germany ..... 2716957

[51] Int. Cl.[2] ..... E04F 17/04; F24F 7/00

[52] U.S. Cl. ..... 181/224; 98/37; 98/40 VM

[58] Field of Search ..... 181/224; 98/37, 39, 98/DIG. 10, 40 VM

[56] References Cited

U.S. PATENT DOCUMENTS 3,507,356 4/1970 Smith ..... 181/224

4,050,364 9/1977 Maus ..... 181/224

FOREIGN PATENT DOCUMENTS 2331841 1/1975 Fed. Rep. of Germany .

7504175 6/1975 Fed. Rep. of Germany .

*Primary Examiner*—L. T. Hix

*Assistant Examiner*—Benjamin R. Fuller

*Attorney, Agent, or Firm*—Norman S. Blodgett; Gerry A. Blodgett

[57] ABSTRACT

Baffle formed with a plurality of molded elastomeric plates within a housing for lining the interior of sound-absorbing ventilators, each plate having a central aperture and grooves in the broad sides of the plates which extend from the aperture to the edge of the plate; the apertures form a channel when the plates are stacked within the housing and the grooves form canals from the channel to the outside of the stacked plates.

13 Claims, 5 Drawing Figures

BAFFLE

BACKGROUND OF THE INVENTION

The invention is concerned with shaped parts which can be used for air and/or sound absorption and may be fabricated of absorbing materials consisting of natural materials, such as wood, or synthetic materials, such as plastic. This invention is especially concerned with shaped parts formed of foam material to be used for lining the housings of sound-absorbing air ventilators, etc., so that it is of advantage that the foam material consist of an elastomeric material, such as sponge-rubber and pliable plastic with a smooth non-porous surface.

It is well known to separate or cut such absorbing material parts with special cutting machines to any desired form and size, especially material parts from prefabricated blocks of foam. However, only shapes of relatively simple form may be fabricated in that way. Sound-absorbing, shaped parts with complicated designs, (especially the ones with apertures and profiled surfaces), however, have to be shaped within a predetermined mold. The base mold may be defined in some cases, directly by the walls of the areas to which the sound absorbing material shapes are applied.

It is also know that the housings of sound-absorbing ventilating devices, etc., for rooms may be equipped with absorbing material, especially foam material linings, as can be seen for example in German Pat. Nos. 2,331,841 and 7,504,175.

In the case of German Pat. No. 2,331,841, at least one part of the wall of a housing having a hollow shape, closing off the inlet air duct, is covered with absorbing flat tiles. According to German Pat. No. 7,504,175, however, the total air duct extending over the housing length and also transverse through the housing is formed of shaped parts made from absorbing material. For fabrication of the housing linings, three different absorbing shaped parts have to be cut and longitudinally fitted and fastened, for example glued, to the housing walls in such a way that, after the mounting of the housing, an air duct is created between them.

For the purpose of cleaning to remove dust and dirt, the housing cover with the fastened absorbing material on the known ventilating devices may be hinged out or in some cases may be removed. However, it is not practical to remove the absorbing parts from the housing for cleaning. These and other difficulties experienced with the prior art device have been obviated in a novel manner by the present invention.

It is, therefore, an outstanding object of the invention to provide a baffle wherein the installation and cleaning of the absorbing parts lining the housing of sound-absorbing ventilator devices are greatly facilitated.

Another object of the invention is the provision of absorbing liner parts which have a superior sound-absorbing design.

A further object of the invention is the provision of absorbing liner parts which can be installed in housings of different lengths.

With these and other objects in view, as will be apparent to those skilled in the art, the invention resides in the combination of parts set forth in the specification and covered by the claims appended hereto.

SUMMARY OF THE INVENTION

In general, the invention solves these problems by providing a plurality of plates fitted to the interior contours of the housing with apertures extending transversely of the plate thickness and with grooves in the broad sides of the plate leading from the narrow opposite plates sides into the apertures. When the plates are installed within the housing, the grooves form ducts or canals leading from the outside of the liner formed by the plates to the channel formed by the apertures in the plates. This invention suggests that one groove in each plate form an air inlet duct and the other groove form an air outlet duct.

In the most simple construction in accordance with this invention, the air inlet duct and the air outlet duct are positioned on the same broad side of the plate. In other cases, the air inlet duct and the air outlet duct are positioned on the broad sides of the plate which are opposite to each other; the ducts extend from each other on opposite sides of the central longitudinal axis of the liner and have a depth which is at least half of the plate thickness, preferably approximately ¾ of the plate thickness.

A further design according to this invention is that the apertures within the plates are of circular cross-section and the ends of the two grooves open diametrically-opposing circumferential sides.

To achieve a good sound effect, it is preferred furthermore, that each of the two grooves have at least one section which is bent in a sharp angle of approximately 45°. Furthermore, it is preferred that the openings of the grooves onto the narrow sides of the plate diverge outwardly.

According to this invention, it is of advantage to place in the channel formed by the plate apertures a rotary blower. It is also advantageous to provide plates which are made of elastomeric foam material, such as sponge-rubber having smooth outer surfaces.

For a perfect fitting to the ventilator device housings of various lengths, several symmetrical plates, with their broad sides abutting, are inserted into the housing as a plate package, whereby the apertures form a channel extending through the entire length of the plate package, and the air inlet ducts are located side-by-side along the length of the package.

For installating in a housing in which the inlet and outlet sides of the housing are equipped with panels having spaced slots, it is advantageous to have the depth of the grooves in the plates the same as the widths as the slots in the panels and to have the separating walls between the grooves of two adjacent plates of a thickness which is equal to the web width between two adjacent slots in the panels. According to this invention, it is not only possible for the two grooves in each plate to open onto narrow sides which are parallel to each other, but, in some cases, it is advantageous for the two grooves to open onto narrow sides which are at a right angle to each other. Finally, it is also possible to mold the grooves in the plates in such a way that they open interchangeably into narrow sides parallel to each other and to narrow sides arranged at an angle to each other.

DESCRIPTION OF THE PREFERRED EMBODIMENT

Figure 1:
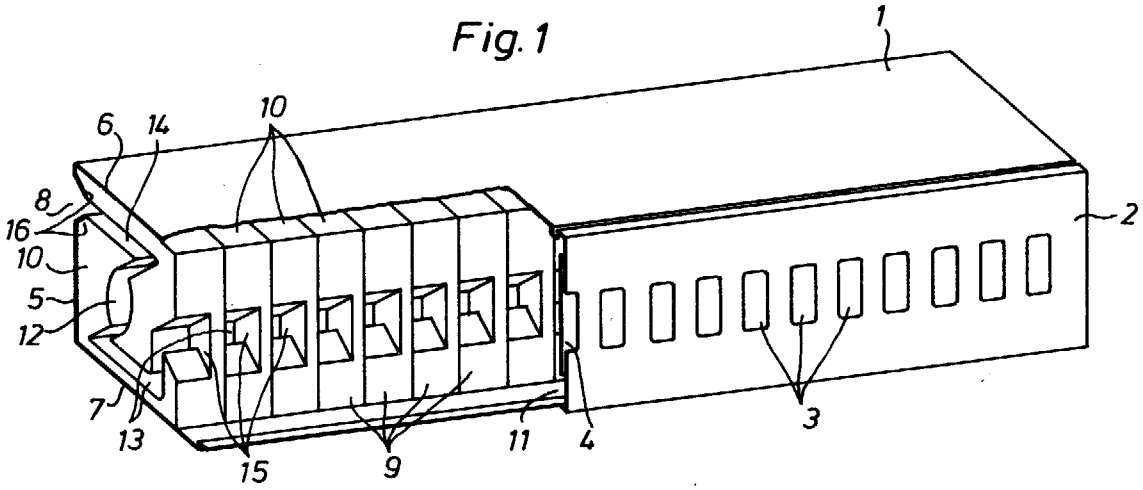
FIG. 1 is a schematic perspective view of a portion of a sound-absorbing ventilator device with parts of absorbing material made in accordance with this invention.

Referring to FIG. 1, there is shown an elongated block-shaped housing 1 of a baffle ventilating device having on one of its long sides a removable panel closure cover 2 which is equipped with air discharge openings 3 equally distributed over its length. An adjustable-displaceable plate 4 is arranged behind cover 2 for selectively opening or closing the air openings 3. The long side 5 opposite the cover 2 is equipped with funnel-shaped openings 8. The hollow space of the housing 1 in its total length and height and for nearly its total width is lined with absorbing material generally indicated by the reference numeral 9. Absorbing material 9 consists of a large number of plate shaped parts 10.

Preferably, the plate-shaped parts or plates 10 of absorbing material are made from sponge-rubber having smooth surfaces or a elastomeric foam plastic and have an outline conforming to the interior space of the housing 1. Because of their soft elastic design, plates 10 may be simply placed into the housing 1 preferably in such a way that a hollow space 11 is formed between the stacked plates 10 and side 2.

Every individual plate 10 of absorbing material is designed with a central aperture 12 extending transverse through the plate. Each aperture 12 is of circular cross-section so that when the plates 10 are arranged within housing 1, their apertures 12 form a channel along the total length of the lining of absorbing material 9. Referring to FIG. 1, each plate 10 has two grooves 13 and 14 which extends along a multi-directional or tortuous path in a broadside of the plate from aperture to opposite side edges of the plate. Each groove 14 has a funnel-shaped open end 16 which opens into slot 8. Each groove 13 has a funnel-shaped end 15 aligned with and spaced from openings 3 within the cover 2.

The broadside of each plate 10 opposite the grooves 13 and 14 is completely flat according to FIG. 1, so that it rests on the side area containing the canals 13 and 14 of a neighboring plate. Consequently, when the plates 10 are aligned with their grooves 13 and 14 facing the same direction as shown in FIG. 1, grooves 13 and 14 form a plurality of multiple angled or tortuous canals leading to channel 12. It can be see that each canal 13 and 14 includes a section which is bent in a sharp angle at 45°. From FIG. 1, it may also be seen that the discharge openings of the two canals 13 and 14 attached approximately tangentially to the diametrically oppositng circumferential sides of aperture 12. The channel formed by the apertures 12 extends through the total length of absorbing material lining 9 and creates an equalization chamber to which are connected all the canals formed by grooves 13 and 14.

The channel formed by apertures 12 may be used for installation of one or several roller ventilators for providing a forced ventilation of a room. For this purpose, the roller ventilator with its directional vane housing is pushed into the channel formed by apertures 12 and before the last plate 10 of the lining 9 is inserted into the housing 1. The elasticity of the individual plates 10 provides vibration dampening support for the ventilator within the housing 1.

Figure 2:
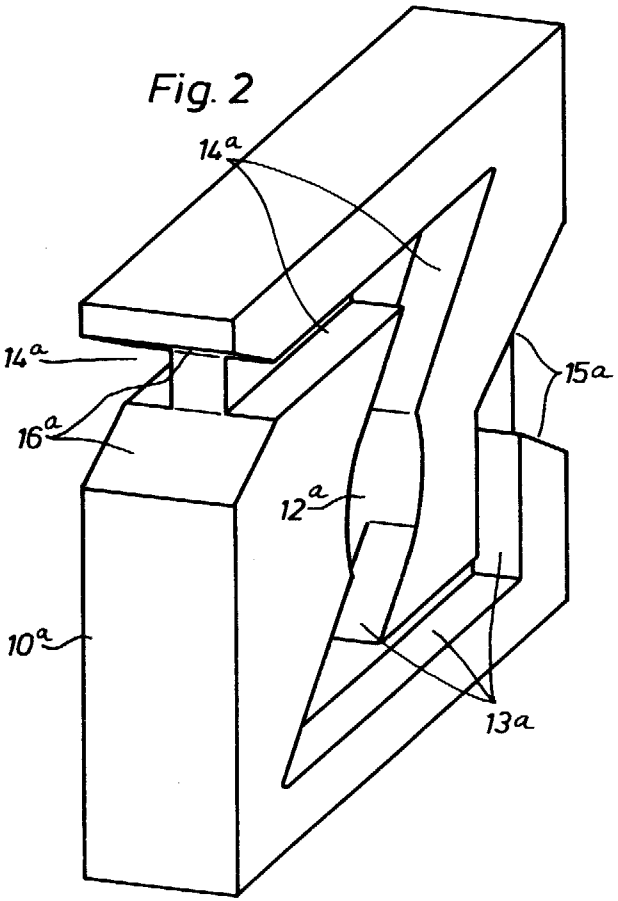
FIG. 2 is a perspective view on an enlarged scale of a first modified design shaped in accordance with the principles of this invention.

FIG. 2 of the drawing shows a first plate modification made of foam material indicated at 10*a* for forming the absorption lining 9 for the ventilator device, shown in FIG. 1. Plate 10*a* differs from plate 10 shown in FIG. 1 in that the two broad sides each contain grooves 13*a* and 14*a* identical in shape to grooves 13 and 14. Grooves 13*a* and 14*a* have funnel-shaped expanded openings 15*a* and 16*a* identical to openings 15 and 16 of the grooves 13 and 14. Grooves 13*a* and 14*a* on one side of the plate are parallel to the grooves 13*a* and 14*a*, respectively on the other side of the plate.

Figure 3:
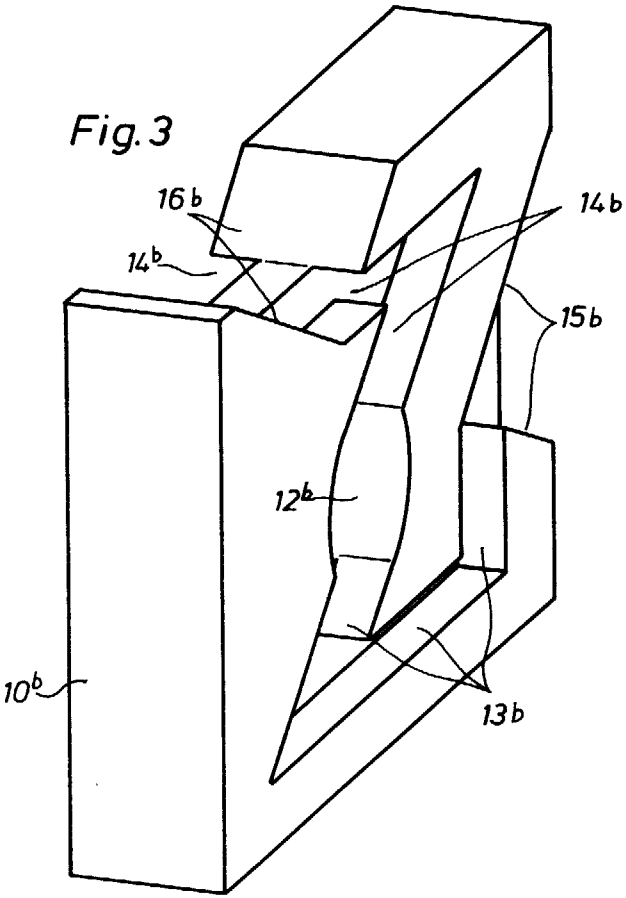
FIG. 3 is a perspective view showing a second modification.

The second modified plate 10*b*, shown in FIG. 3, differs from plate 10*a* shown in FIG. 2 in that grooves 14*b* have a common funnel-shaped opening 16*b* guided towards and located at the top edge or outer edge which is at a right angle to the other outer edge on which the funnel-shaped expanded end 15*b* of groove 13*b* is located.

Figure 4:
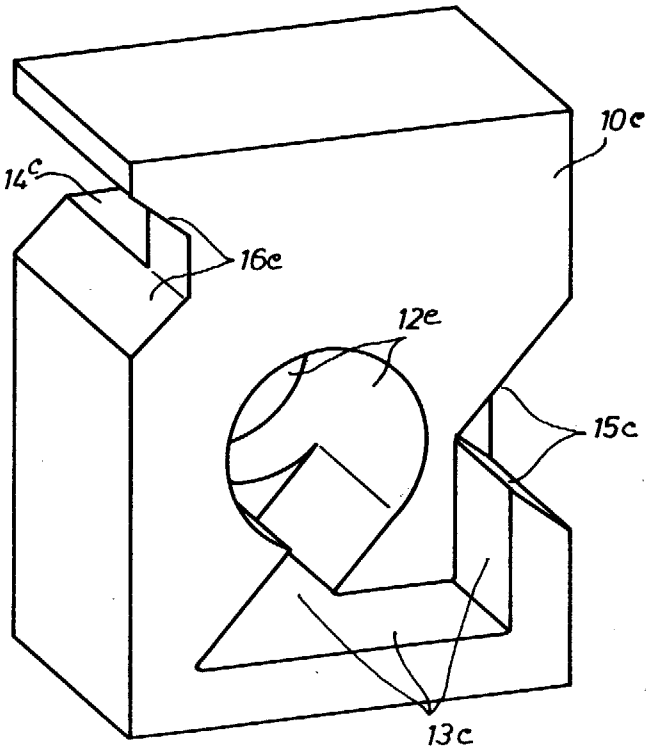
FIGS. 4 and 5 are perspective views showing a third modification as viewed from opposite broad sides.
Figure 5:
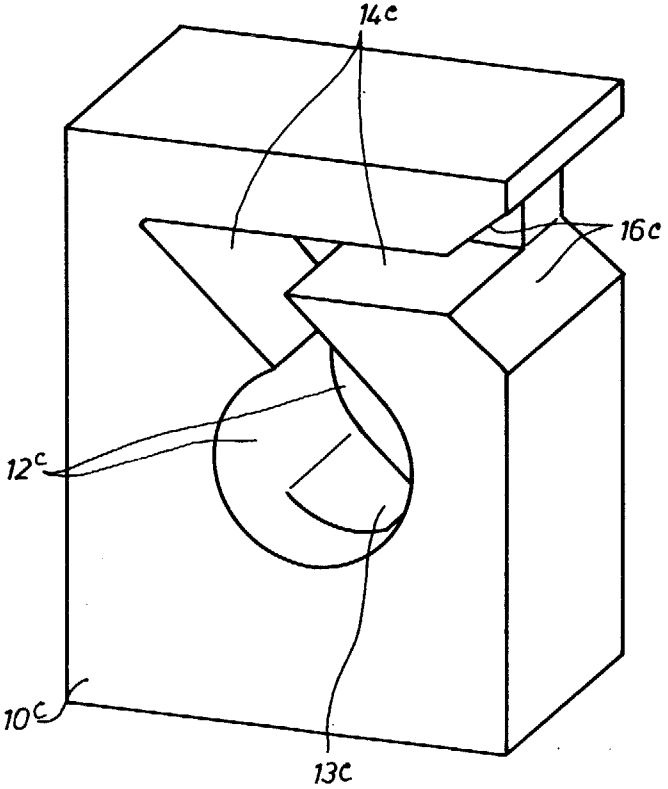

FIGS. 4 and 5 show a third modified plate 10*c* made from foam material by which the groove 13*c* is located in one broad side and canal 14*c* in the other broad side. Both canals 13*c* and 14*c*, therefore, have in the direction of the longitudinal axis of the penetration channel formed by apertures 12, a displaced position against each other and preferably have a profile depth which is approximately ¾ of the total plate thickness. This means that half of the cross-section of the grooves 13*c* and 14*c* are located within the same vertical plane within the plate 10*c* and ¼ of the profile depth of both grooves 13*c* and 14*c* are offset from this plane toward the outside. Plates 10 shown in FIGS. 4 and 5 have been found to be particularly effective when the funnel-shaped openings 15*c* and 16 of the grooves 13*c* and 14*c* extend over the whole plate thickness, so that a flow equalization can be achieved not only within the channel of the absorbing lining 9, formed by the apertures 12, but in addition also within the area of the openings or slots 3 and the opening 8, a flow equalization may be achieved. It is particularly important that the plates 10, 10*a*, 10*b*, and 10*c* are resilient along the longitudinal axis of the channel formed by apertures 12 so that sections of different lengths in the form of packages may be inserted into the housing 1 without any difficulties. For the purpose of cleaning, for example by a detergent, the plates 10*a*, 10*b*, and 10*c* may be removed from the housing 1 individually or in a package after the cover 2 has been removed from the housing.

The previously-described absorbing liners made of especially shaped parts from foam material are used for the lining of all ventilator devices which on one hand are connected to the outside air and on the other hand to inside space. Such ventilator devices may be installed into walls, ceilings and floors. Especially, however these absorbing shapes from foam material are suitable for installation into such ventilator devices which are integral with sound absorbing window and door designs. Such sound absorbing window and door designs are generally designed in such a way that they may not be opened or only opened for the purpose of cleaning so that the necessary air exchange between the rooms and their surroundings, special sound absorbing ventilator devices have to be provided.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A baffle liner of molded shapes made from elastomeric material for lining the interiors of housings of sound absorbing ventilator devices comprising a plurality of plates, each having two broad sides and a transverse aperture through the plate thickness and at least two grooves in the broad sides of the plate leading from said aperture to opposite narrow sides of the plate and forming exit openings in said respective sides.

2. A baffle liner as recited in claim 1, wherein each of the grooves extend in a tortuous path, one of the grooves forming an air inlet and the other groove forming an air outlet.

3. A baffle liner as recited in claim 1, wherein the grooves of each plate are positioned on the same broad side of the plate.

4. A baffle liner as recited in claim 1, wherein the grooves for each plate are positioned on opposite broad sides of the plate and displaced from each other on opposite sides of the axis of the transverse opening and are of a depth which is greater than one half of the plate thickness.

5. A baffle liner as recited in claim 1, wherein the transverse apertures within each plate is of circular cross-section and the exit openings of the grooves are located at diametrical opposing points along a line taken through the center of the transverse apertures.

6. A baffle liner as recited in claim 1, wherein each of the two grooves in each plate liner has at least one section which extends from an adjacent section at an angle of 45°.

7. A baffle liner as recited in claim 1, wherein the exit openings of the grooves diverge outwardly.

8. A baffle liner as recited in claim 1, wherein a roller ventilator is located within the apertures of the plates.

9. A baffle liner as recited in claim 1, wherein each plate consists of resilient foam material with smooth outside surfaces.

10. A baffle liner as recited in claim 1, wherein plates are identical and the broad sides of the plates abut to form a plate package and whereby their transverse apertures form a channel which extends over the total length of the baffle and the grooves leading into the channel are aligned along the longitudinal direction of the baffle.

11. A baffle liner as recited in claim 1, wherein the housings of the ventilator devices have an inlet side and an outlet side, each equipped with slotted plates, and wherein the depth of each groove correspond to the width of the slots in the slotted plates and the distance between the base of the groove and the opposite width of the plates are equal to the web width between the slots in the panel on the outlet side.

12. A baffle liner as recited in claim 1, wherein the grooves in each plate extend to sides of the plate which are parallel.

13. A baffle liner as recited in claim 1, wherein the grooves in each plate extend to sides which are disposed at a right angle to each other.

* * * * *